US005907737A

United States Patent [19]

Isokawa et al.

[11] Patent Number: 5,907,737

[45] Date of Patent: May 25, 1999

[54] LIGHT SENSITIVE MATERIAL PROCESSING APPARATUS

[75] Inventors: Wataru Isokawa; Kenji Yamanouchi; Hiroshi Furuuchi, all of Hino, Japan

[73] Assignee: Konica Corporation, Japan

[21] Appl. No.: 09/020,563

[22] Filed: Jan. 12, 1998

[30] Foreign Application Priority Data

Jan. 22, 1997 [JP] Japan ..... 9-009420

[51] Int. Cl.[6] ..... G03D 3/02

[52] U.S. Cl. ..... 396/626; 396/636; 396/641

[58] Field of Search ..... 396/626, 636, 396/641; 430/30, 398–400

[56] References Cited

U.S. PATENT DOCUMENTS 5,669,035 9/1997 Kurematsu et al. ..... 396/626

*Primary Examiner*—D. Rutledge

*Attorney, Agent, or Firm*—Jordan B. Bierman; Bierman, Muserlian and Lucas

[57] ABSTRACT

A light-sensitive material processing apparatus comprises a circulating path through which processing solution in a processing tank is circulated; a pump for circulating the processing solution through the circulating path; and an oxidation promoting section provided to at least one of a part of the processing tank and a part of the circulating path, the oxidation promoting section having a depth shallower than that of the processing tank and a upper portion open to atmosphere, wherein a flow speed of the processing solution at the oxidation promoting section is not slower than $1\times10^3$ mm/min.

18 Claims, 4 Drawing Sheets

LIGHT SENSITIVE MATERIAL PROCESSING APPARATUS

BACKGROUND OF THE INVENTION

The present invention relates to a light-sensitive material developing apparatus, and more particularly to a technology to promote oxidation of a processing liquid having a bleaching ability and minimize reduction of the power of the processing liquid.

Photographic processing of a negative color silver halide light-sensitive material is composed of color developing, bleaching, fixing or bleach-fixing, stabilizing or washing. If the processing liquid, specifically the processing liquid including bleaching is not suitable oxidized, deterioration of the processing liquid advances rapidly. If such condition is remained, reduction of finished developing is resulted in. Therefore, in order to inhibit deterioration phenomenon of the processing liquid, a means to feed air into the processing liquid by means of an air pump as shown in Konica KP50QA and Noritsu V50 is adopted, or a means to enhance opportunity to cause the processing liquid to contact oxygen in the air by spraying the processing liquid to the ambient air from a shower-type nozzle.

However, since the above-mentioned air-pump-using air feeding type and a shower type include air into the processing liquid. Therefore, bubbling occurs. Bubbles overflows outside the tank so that the surrounding is contaminated. In addition, if the processing liquid containing the overflowed bubbles enters into the adjoining processing liquid, fatal problems appears in processability.

Further, in the case of an air pump type, an air pump is separately necessary, and in the case of a shower type, shower tank is necessary separately. Therefore, cost is enhanced and the apparatus is enlarged.

In the case of a shower type, circulation use for stirring the processing liquid and for showering the processing liquid, if the flow amount of stirring and circulation becomes small, stirring property becomes deteriorated. In order to avoid aforesaid problem, a large scale pump becomes necessary. Therefore, equipment cost is enhanced and downsizing of the equipment is hindered.

SUMMARY OF THE INVENTION

An objective of the present invention is to stabilize processability and extend life of the processing liquid by appropriately oxidizing the processing liquid and to provide a light-sensitive material developing apparatus which minimizes the above-mentioned shortcomings and problems which have occurred so far.

Aforesaid objectives are attained by either of the above-mentioned technical means (1) through (8).

Item (1)

A light-sensitive material processing apparatus comprising the following structure:

a processing tank which houses a processing liquid;

a circulation path which circulates the processing liquid in the above-mentioned processing tank; and a circulation means which circulates the above-mentioned processing liquid through the above-mentioned circulation path;

wherein a part of the above-mentioned processing tank or a part of the above-mentioned circulation path is used as an oxidation promotion section in which the upper surface of the liquid is exposed to ambient air and the flow rate of the processing liquid in the above-mentioned oxidation promotion section is $1\times10^3$ mm/min. or more.

Item (2)

The light-sensitive material processing apparatus described in item (1) above, wherein the flow rate of the processing liquid in the above-mentioned oxidation promotion section is $1\times10^3$ mm/min. or more and the surface area of a portion where the upper surface of the liquid exposed to the ambient air is 1000 $mm^2$ or more.

Item (3)

A light-sensitive material processing apparatus comprising the following structure:

a processing tank which houses a processing liquid;

a circulation path which circulates the processing liquid in the above-mentioned processing tank; and a circulation means which circulates the above-mentioned processing liquid through the above-mentioned circulation path;

wherein a part of the above-mentioned processing tank or a part of the above-mentioned circulation path is used as an oxidation promotion section in which the upper surface of the liquid is exposed to ambient air, wherein (the flow rate of the processing liquid)×(the surface area of a portion where the upper surface of the liquid is exposed to the ambient air) is $2\times10^6$ $mm^3$/min or more.

The light-sensitive material processing apparatus described in item (1) above, wherein (the flow rate of the processing liquid)×(the surface area of a portion where the upper surface of the liquid is exposed to the ambient air) is $2\times10^6$ $mm^3$/min or more.

Item (4)

The light-sensitive material processing apparatus described in item (1) or item (3) above, wherein, provided that a constant of air oxidation is determined by dividing ferrous complex salt density [g/l] by number of days which represents the condition in which the ferric complex salt in the above-mentioned processing liquid changes to a ferrous complex salt, and the above-mentioned constant of an air oxidation is 0.1 or more.

Item (5)

The light-sensitive material processing apparatus described in item (1) or item (3) above, wherein the walls or the bottom of the above-mentioned oxidation promotion section is corrugated.

Item (6)

The light-sensitive material processing apparatus described in item (1), item (3) or item (4) above, wherein the distance from the surface of the liquid to the bottom thereof, in the above-mentioned oxidation promotion section, is not uniform.

Item (7)

The light-sensitive material processing apparatus described in item (5) above, wherein a part of corrugation provided on the wall or on the bottom of the above-mentioned oxidation promotion section projects above the liquid surface of the processing liquid.

Item (8)

The light-sensitive material processing apparatus described in item (1), item (3), item (4), item (5) or item (7) above, wherein circulation conducting to achieve the above-mentioned oxidation promotion and of the processing liquid in the processing tanks is combined by a single pump.

Item (9)

The light-sensitive material processing apparatus described in item (1), item (3), item (4) or item (5) above, wherein the above-mentioned processing liquid is a processing liquid having a bleaching ability.

Item (10)

The light-sensitive material processing apparatus described in item (1), item (3), item (4) or item (5) above, wherein the above-mentioned processing liquid is a processing liquid having a fixing ability.

DETAILED DESCRIPTION OF THE PREFERRED EMBODIMENT

Embodiment of the present invention will be explained referring to drawings.

Figure 1:
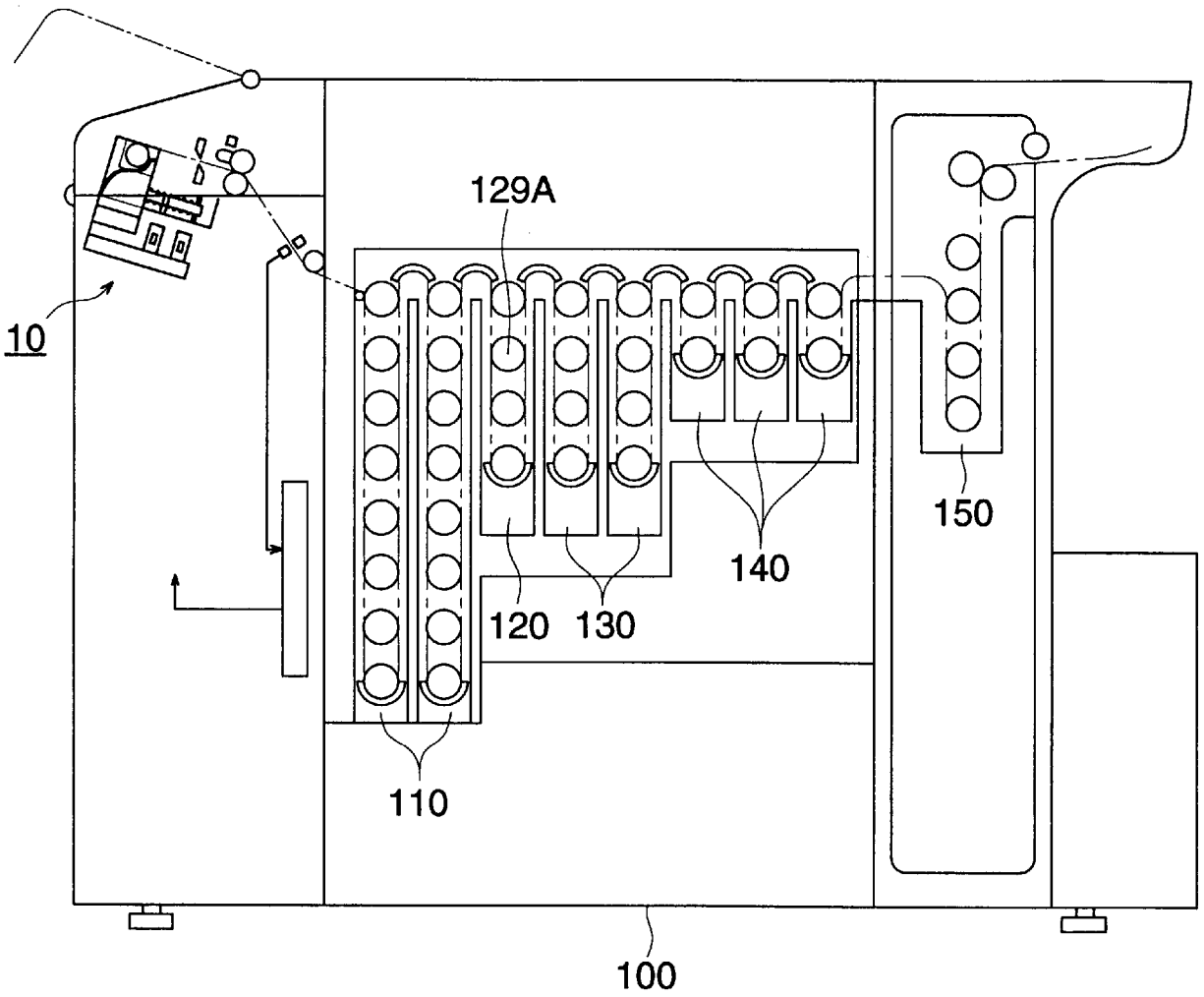
FIG. 1 shows a side cross sectional view of a light-sensitive material developing apparatus of the present invention.
Figure 2:
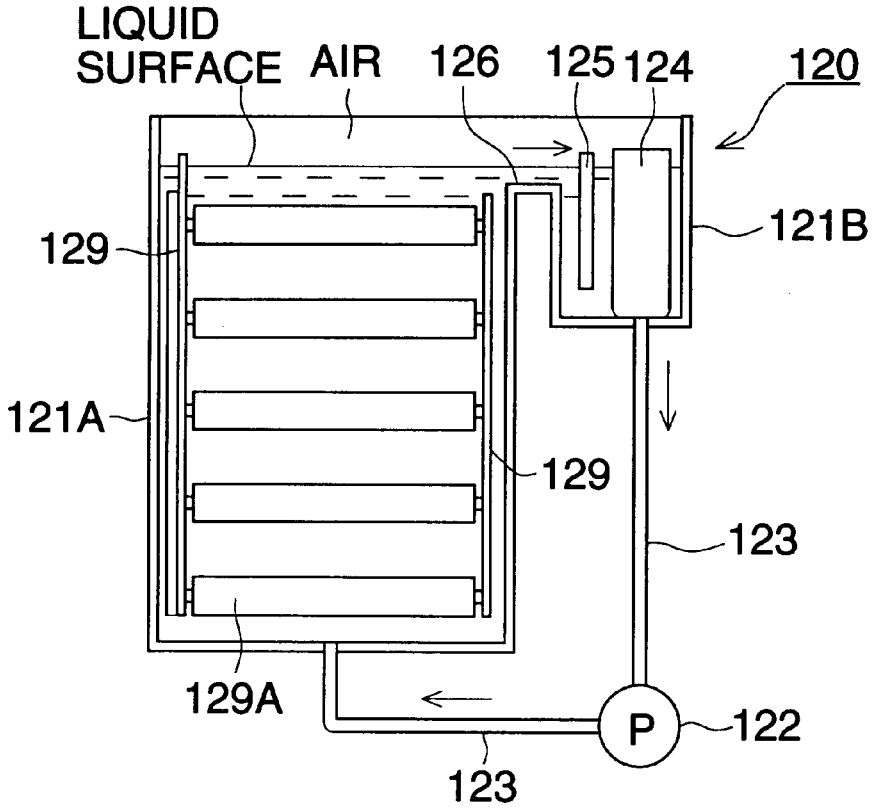
FIG. 2 shows a front cross sectional view of a bleaching section of FIG. 1.

FIG. 1 shows a side cross sectional view of a light-sensitive material developing apparatus of the present invention. FIG. 2 shows a front cross sectional view of its bleaching section.

Aforesaid developing apparatus 100 develops a silver halide light-sensitive material for color negative, and is composed of feeding section 10 of an exposed light-sensitive material contained in a cartridge, color developing section 110, bleaching section 120, fixing section 130 and stabilizing section 140 and replenishing section of a processing solution into a processing tank in each processing section and a processing solution circulation mechanism. Further, drying section 150 is provided. Thus, the light-sensitive material developing apparatus is formed.

Depending upon the kind of a color light-sensitive material, a bleach-fixing tank is provided in place of a separate bleaching tank and a fixing tank.

In this example, in bleaching tank 121 in bleaching section 120, oxidation promotion section 126 for promoting oxidation by contacting the ambient air with a processing solution in the flowing path is provided. Further, a processing solution circulation means for high speed passing of a processing solution in aforesaid oxidation promotion section 126 and also for stirring for uniformity of the processing solution in the tank.

In bleaching tank 121 in bleaching section 120, rack 129 is immersed. Tank 121A in which a light-sensitive material is conveyed along with conveyance roller 129A on aforesaid rack 129 while being bleached and tank 121B in which filter 124 and heater 125 are provided are connected by means of oxidation promotion section 126. Outside the above-mentioned tanks 121A and 121B is connected with pump 122 (a circulation means) and pipe 123 (a circulation path) for forming a circulation route. As described above, a bleaching solution in bleaching tank 121A is stirred in the tank so that uniformity of solution is contrived. Together with this, aforesaid bleaching solution flows oxidation promotion section 126 having shallow bottom at high flow rate. While increasing contactability with air and receiving influence by heater 125 for temperature-regulation, and while also maintaining cleaning the processing solution at filter 124, the bleaching solution circulates by means of pump 122.

Oxidation promotion section 126 contacts air in which the liquid surface thereof is almost the same as that of the above-mentioned tanks 121A and 121B. The bottom portion of aforesaid oxidation promotion section 126 is shallow, in which its flow rate is $1\times10^3$ mm/min. or more. If its flow rate is $1\times10^3$ mm/min. or more, more preferable effects can be obtained. Moreover, $2\times10^3$ mm/min. or more is more preferable, 5 and$\times\mathbf{10}^3$ mm/min. or more is specifically more preferable.

In the oxidation promotion section, the surface area exposing the upper portion to the ambient air, i.e., contacting ambient air, is preferably 1,000 $mm^2$. In addition, the surface area exposing the upper portion to the ambient air is more preferably 2,000 $mm^2$. Incidentally, "exposing to the ambient air" means that the surface of the processing solution contacts the ambient air. Even if the area above of the liquid surface of the processing solution is covered with a lid, it is allowed if the ambient air contacts the surface of the processing solution.

In addition, it was proved that, if "the surface area×flow rate" of the processing solution (here, a bleaching solution) which passes the oxidation promotion section is $2\times10^6$ $mm^3$/min., noticeable effects are provided for oxidation promotion.

Figure 3:
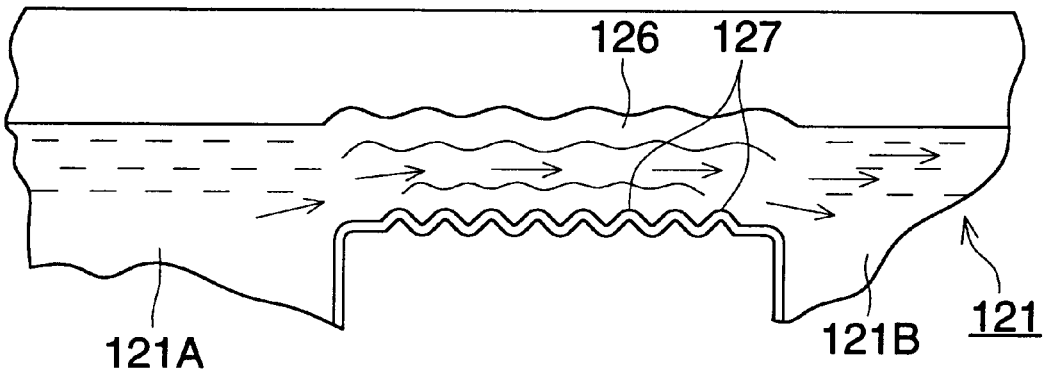
FIG. 3 shows a part enlarging drawing of one example of an oxidation promotion section of the present invention.
Figure 4:
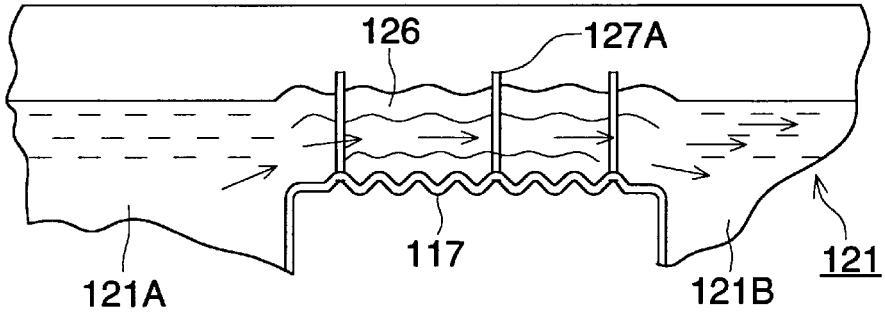
FIG. 4 shows a part enlarging drawing of another example of an oxidation promotion section of the present invention.

It is preferable that the bottom portion of the oxidation promotion section is not flat but that corrugation 127 is provided as shown in part enlarged drawings for oxidation promotion section of FIGS. 3 and 4. In addition, a part of corrugation (head portion 127A) may protrude above the liquid surface, as shown in the enlarged drawing in FIG. 4.

Since oxidation promotion due to turbulence is further accelerated, it is considered that its effectiveness is preferable.

Above example is a just one of the effective examples. Other examples are as follows. Several protuberances are arranged on the bottom of the oxidation promotion section in which a height of the protuberance is longer than the depth of the solution flow. An example of the protuberance is 8×1×20 (mm).

Ordinarily, the bleaching solution has a function to change silver in a silver image obtained through developing to a silver halide. It utilizes oxidation effect of a bleaching agent on silver. As a bleaching agent, red purussiate and ferric salt of aminopolycarboxylic acid such as ferric acid of EDTA (ethylenediamine·tetraacetic acid) and ferric acid of 1,3 PDTA (1,3-propylenediamine·tetraacetic acid) are used in which a halogenated substance is used as a bleaching accelerating agent. Silver salt which occurred due to oxidation by bleaching becomes silver halide.

Aforesaid reaction formula functions to change $Fe^{3+}$ to $Fe^{2+}$, as described in $$Ag+Nh_4[Fe^{3+}-Y]+NH_4Br\rightarrow AgBr+(NH_4)_2[Fe^{2+}-Y]$$

The density of $Fe^{2+}$ is the density of a ferrous complex salt. The density of $Fe^{3+}$ is the density of a ferric complex salt.

The target of favorable bleaching capacity is that the density of ferric complex salt is 16.5 g/l. In order that bleaching capacity is stable even after 100 rolls of 24 EX 135 type is developed, it is necessary that the density of ferric complex salt is 16.5 g/l or less.

With regard to aforesaid bleaching agents, it tends that ferric salt of aminopolycarboxylic acid which does not dispose of cyan is used in stead of red prussiate which disposes of cyan (CN). However, compared with red prussiate, ferric salt of aminopolycarboxylic acid has inferior oxidation effects. Accordingly, ferric salt of aminopolycarboxylic acid is disadvantageous for color film having large silver amount, though advantageous for color paper in which amount of silver spent is small. However, in view of environmental concern, emulsions in which the amount of silver is reduced has come to be adopted in a color film. Under such condition, bleaching has come to be conducted with ferric salt of aminopolycarboxylic acid. However, a demerit that the oxidation function of ferric salt of aminopolycarboxylic acid remains under aforesaid conditions. Therefore, an objective of the present invention is to provide effective oxidation without increasing the cost on oxidation promotion function which mechanically assists low oxidation function by ferric salt of aminopolycarboxylic acid and without contaminating around the processing tank due to spattering.

Namely, oxidation promotion section is provided in bleaching tank 121 or bleach-fixing tank for attaining the objective.

In order to promote oxidizing as much as possible, area of the surface to contact ambient air of oxidation promotion section 126 is increased by increasing the flow rate. In order to additionally effectuate contact with ambient air in oxidation promotion section, corrugation 127 is provided on the bottom of the flow path or head portion 127A which pushes up above the liquid surface is provided for creating turbulence.

In addition, an oxidation promotion section may be provided in the part of a circulation flow path, while not providing an oxidation promotion section in a part of a processing tank. "be provided in the part of a circulation flow path" includes to provide a tank, at a part of a circulation path separately from the processing tank, which is determined to be an oxidation promotion section.

EXAMPLES

With regard to the following Examples and Comparative Examples, a constant for the speed of air oxidation was determined. In addition, with regard to respective Examples and Comparative Examples, the density range of ferric complex salt in terms of (g/l) progressively narrows after 10 rolls, 30 rolls, 60 rolls and 100 rolls are respectively processed a day was measured.

With regard to Examples and Comparative Examples, contamination around the processing tank after 100 rolls of 24 EX 135 type roll films was investigated.

The "constant for the speed of air oxidation", which is represented by $K_0$, means an incline between time (the horizontal axis) and a logarithmic value (the vertical axis) when the logarithmic value of the density of $Fe^{2+}$, namely the density of ferric complex salt, is plotted on time in terms of day.

EXAMPLE 1

An experiment was conducted using an apparatus having a structure shown in FIG. 2.

The flow rate in the oxidation promotion section was 1,000 m/min., the surface area exposing the ambient air in the oxidation promotion section was 1,000 $mm^2$, the flow rate×the surface area $1\times10^6$ $mm^3$/min. and the depth from the surface of the liquid to the bottom of the oxidation promotion section (the uniform flat surface) was 15 mm.

EXAMPLE 2

An experiment was conducted using an apparatus having a structure shown in FIG. 2.

The flow rate in the oxidation promotion section was 2,000 m/min., the surface area exposed to the ambient air in the oxidation promotion section was 1,000 $mm^2$, the flow rate×the surface area $2\times10^6$ $mm^3$/min. and the depth from the surface of the liquid to the bottom of the oxidation promotion section (the uniform flat surface) was 15 mm.

EXAMPLE 3

An experiment was conducted using an apparatus having a structure shown in FIG. 2.

The flow rate in the oxidation promotion section was 5,800 m/min., the surface area exposed the ambient air in the oxidation promotion section was 2,120 $mm^2$, the flow rate× the surface area $12.3\times10^6$ $mm^3$/min. and the depth from the surface of the liquid to the bottom of the oxidation promotion section (the uniform flat surface) was 15 mm.

Comparative Example 1

An experiment was conducted using an apparatus having a structure shown in FIG. 2.

The flow rate in the oxidation promotion section was 500 m/min., the surface area exposed to the ambient air in the oxidation promotion section was 1,000 $mm^2$, the flow rate× the surface area $0.5\times10^6$ $mm^3$/min. and the depth from the surface of the liquid to the bottom of the oxidation promotion section (the uniform flat surface) was 15 mm.

Comparative Example 2

An experiment was conducted using an apparatus having a structure shown in FIG. 2.

The flow rate in the oxidation promotion section was 800 m/min., the surface area exposed to the ambient air in the oxidation promotion section was 1,000 $mm^2$, the flow rate× the surface area $0.8\times10^6$ $mm^3$/min. and the depth from the surface of the liquid to the bottom of the oxidation promotion section (the uniform flat surface) was 15 mm.

Comparative Example 3

An aeration and air-pump type apparatus having the same scale as Examples 1 through 3 and Comparative Examples 1 and 2 was employed.

Comparative Example 4

An aeration and shower type apparatus having the same scale as Examples 1 through 3 and Comparative Examples 1 and 2 was employed.

Results

Figure 5:
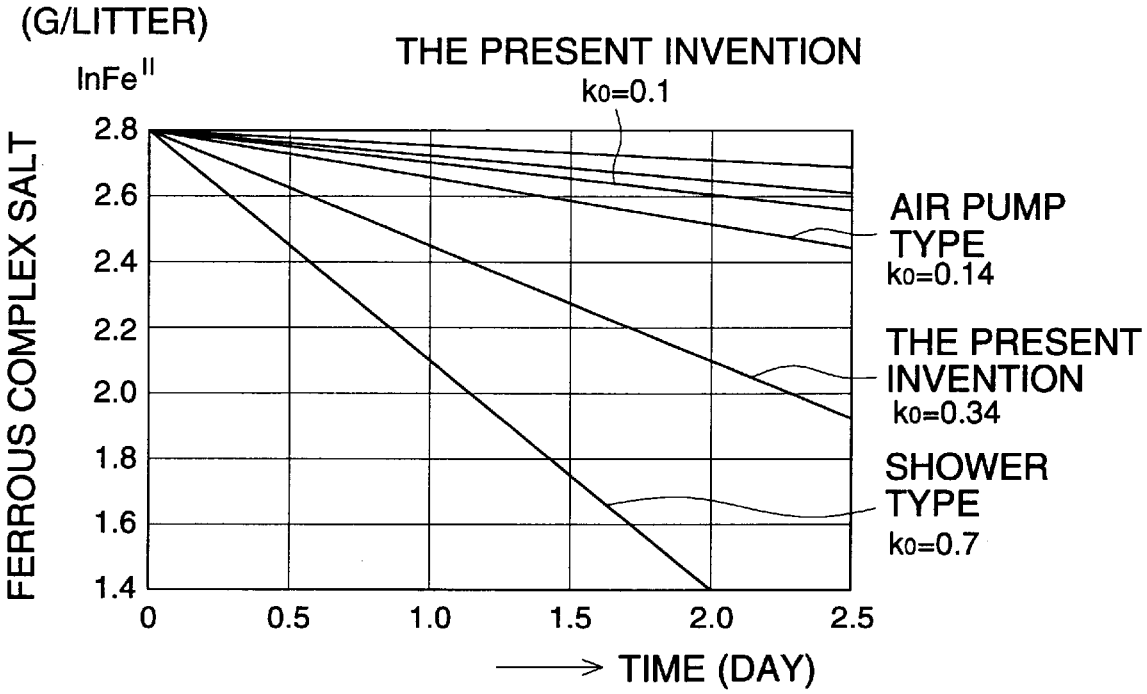
FIG. 5 shows a graph showing a change of ferrous complex salt in terms of time.

Table 1 shows the results thereof. FIG. 5 shows the graph thereof.

| | Example 1 | Example 2 | Example 3 | Comp. 1 | Comp. 2 | Comp. 3 | Comp. 4 |
|---|---|---|---|---|---|---|---|
| $k_0$ | 0.1 | 0.13 | 0.34 | 0.08 | 0.09 | 0.14 | 0.70 |
| 10 rolls were processed (g/l) | 10.3 | 8.8 | 3.40 | 11.6 | 11.0 | 8.12 | 1.72 |
| 30 rolls were processed (g/l) | 12.4 | 10.9 | 4.55 | 13.6 | 12.9 | 10.2 | 2.40 |
| 60 rolls were processed (g/l) | 14.5 | 13.1 | 6.07 | 15.7 | 15.1 | 12.4 | 3.33 |
| 100 rolls were processed (g/l) | 16.5 | 15.1 | 7.80 | 17.5 | 17.0 | 14.5 | 4.93 |
| Ambient contamination | A | A | A | A | A | B | B |

Figure 6:
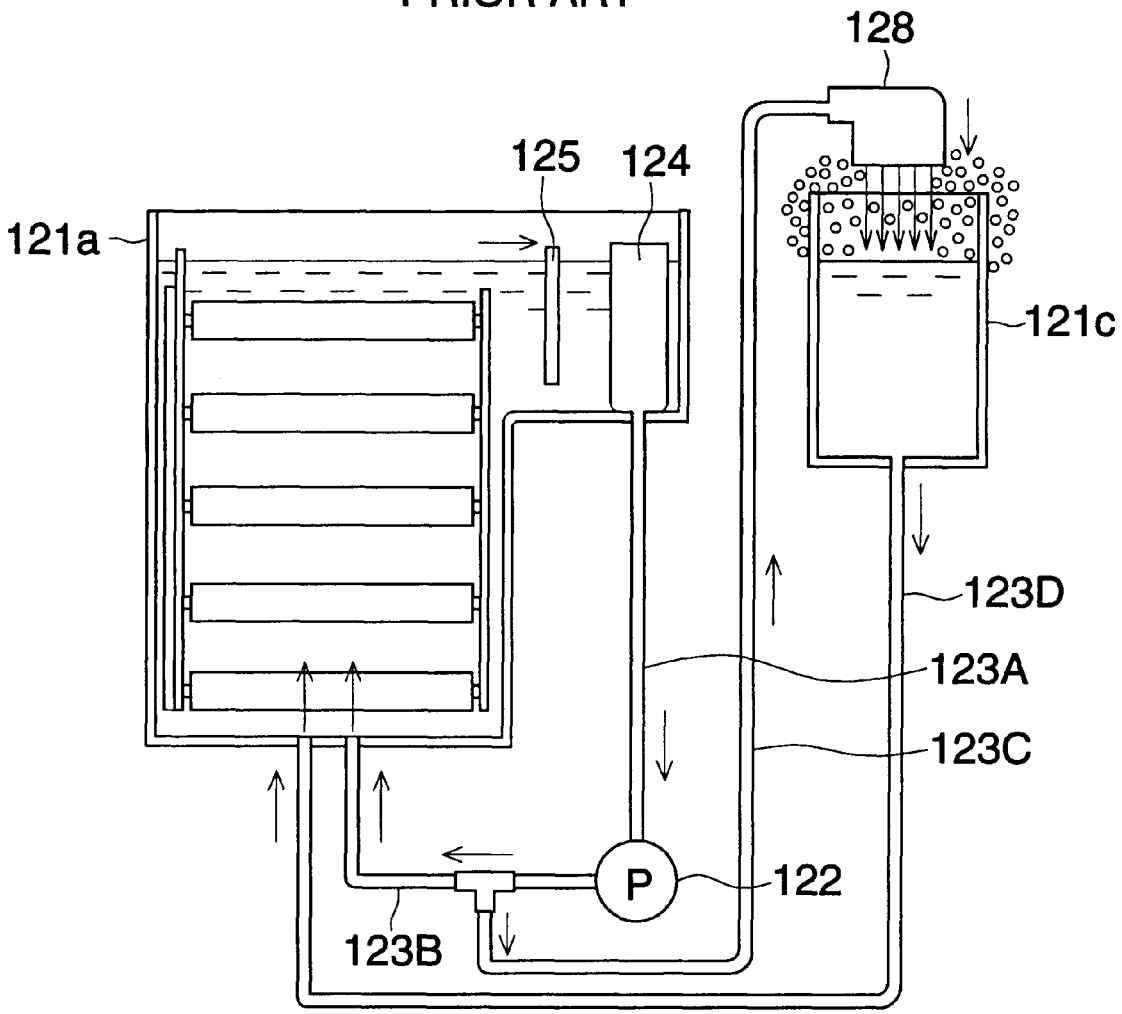
FIG. 6 PRIOR ART
FIG. 6 shows a front cross sectional view of a shower type aeration system bleaching section of the prior art.

With regard to Comparative Examples 1 and 2, the density of ferric complex salt which progressively narrows after processing 100 rolls was larger than 16.5 g/l, which is not suitable for practical use. With regard to Comparative Examples 3 and 4, the occurrence of bubble is so vigorous that the bubbles overflow for contaminating the area surrounding the processing tank. Therefore, they are not suitable for practical use. As shown in FIG. 6, in the case of Comparative Example 4, a single pump is used for circulation of bleaching liquid in bleaching tank 121*a* and showering by spray 128 through pipes 123A, 123B, 123C and 123D. Therefore, there occurs disadvantage cost in increased due to increase of circulation power and separate provision of shower tank 121*c*.

On the contrary, in the case of Examples 1, 2 and 3, the density of ferric complex salt which progressively narrows after processing 100 rolls was less than 16.5 g/l. Therefore, a light-sensitive material can be processed without the necessity to fear reduction of the power of bleaching. In addition, little contamination around the bleaching tank is observed. Further, large scale equipment is not necessary. Therefore, they are advantageous in terms of cost.

Incidentally, the developing apparatus having the above-mentioned structure has noticeable effects on a developing apparatus having a bleach-fixing tank. In addition, it was advantageous when being used for a fixing tank.

All examples in explained above was measured under the same condition of using same quantity of the processing liquid: 3.9 1. In the example of the FIG. 3, oxidation promotion effect was about 5–10% up than the examples 1, 2 and 3. In the example of FIG. 4, oxidation promotion effect progressed 10–20% higher than the examples of examples 1, 2 or example 3. Solution lowing cross section of the oxidation promotion section was 40 mm (w)×15 mm (D). Length of the oxidation promotion section was 60 mm. This length may be shorter by the resolving the shape or arrangement of the protuberances. Depth of the solution flow in oxidation promotion section, preferably recommended between 5 mm and 50 mm. If under 5 mm, it is hard to circulate the solution flow stationally. If over 50 mm, it is hard to get the oxidation promotion effectiveness.

Owing to the light-sensitive material developing apparatus having an oxidation promotion section of the present invention, oxidation of a bleaching liquid was promoted and photographic processing of a light-sensitive material was conducted effectively and stably. In addition, disadvantages in conventional air-pump type or shower type aeration oxidation promotion that the bleaching liquid enters into the adjoining tank accompanying bubbling or processing quality is extremely reduced due to deterioration of the developing liquid is minimized, and photographic processing of the light-sensitive material is conducted effectively. Without complicating and enlarging the apparatus, photographic processing can be conducted with an apparatus having a small-size and being relatively inexpensive.

What is claimed is:

1. A light-sensitive material processing apparatus, comprising:

a processing tank in which a processing solution is stored;

a circulating path through which the processing solution in the processing tank is circulated;

circulating means for circulating the processing solution through the circulating path; and an oxidation promoting section provided to at least one of a part of the processing tank and a part of the circulating path, the oxidation promoting section having a depth shallower than that of the processing tank and a upper portion open to atmosphere, wherein a flow speed of the processing solution at the oxidation promoting section is not slower than $1\times10^3$ mm/min.

2. The apparatus of claim 1, wherein an area of the upper portion open to atmosphere where the flow speed of the processing solution at the oxidation promoting section is not slower than $1\times10^3$ mm/min is not smaller than 1000 $mm^2$.

3. The apparatus of claim 1, wherein a value obtained by multiplying the flow speed of the processing solution with the area of the upper portion open to atmosphere at the oxidation promoting section is not smaller than $2\times10^6$ $mm^3$/min.

4. The apparatus of claim 1, wherein in a graph in which the axis of ordinates is represented by a logarithm value of a concentration of ferrous complex salt (g/l) and the axis of abscissas is represented by a number of days, a coefficient representing the inclination of a line in the graph is used as an air oxidation coefficient representing a condition that ferric complex salt changes to ferrous complex salt and the air oxidation coefficient is not smaller than 0.1.

5. The apparatus of claim 1, wherein at least one of a wall and a bottom surface is rough with protuberances.

6. The apparatus of claim 1, wherein a distance between a solution surface and bottom surface at the oxidation promoting section is not even.

7. The apparatus of claim 1, wherein a part of a protuberances portion provided on at least one of a wall and a bottom surface at the oxidation promoting section is located above a solution surface.

8. The apparatus of claim 1, wherein the solution subjected to oxidation promoting process and the solution in the processing tank are circulated by the same pump.

9. The apparatus of claim 1, wherein the processing solution is a solution having a bleaching ability.

10. The apparatus of claim 1, wherein the processing solution is a solution having a fixing ability.

11. A light-sensitive material processing apparatus, comprising:

a processing tank in which a processing solution is stored;

a circulating path through which the processing solution in the processing tank is circulated;

circulating means for circulating the processing solution through the circulating path; and an oxidation promoting section provided to at least one of a part of the processing tank and a part of the circulating path, the oxidation promoting section having a depth shallower than that of the processing tank and a upper portion open to atmosphere, wherein a value obtained by multiplying the flow speed of the processing solution with the area of the upper portion open to atmosphere at the oxidation promoting section is not smaller than $2\times10^6$ $mm^3$/min.

12. The apparatus of claim 11, wherein in a graph in which the axis of ordinates is represented by a logarithm value of a concentration of ferrous complex salt (g/l) and the axis of abscissas is represented by a number of days, a coefficient representing the inclination of a line in the graph is used as an air oxidation coefficient representing a condition that ferric complex salt changes to ferrous complex salt and the air oxidation coefficient is not smaller than 0.1.

13. The apparatus of claim 11, wherein at least one of a wall and a bottom surface is rough with protuberances.

14. The apparatus of claim 11, wherein a distance between a solution surface and bottom surface at the oxidation promoting section is not even.

15. The apparatus of claim 11, wherein a part of a protuberances portion provided on at least one of a wall and a bottom surface at the oxidation promoting section is located above a solution surface.

16. The apparatus of claim 11, wherein the solution subjected to oxidation promoting process and the solution in the processing tank are circulated by the same pump.

17. The apparatus of claim 11, wherein the processing solution is a solution having a bleaching ability.

18. The apparatus of claim 11, wherein the processing solution is a solution having a fixing ability.

* * * * *